United States Patent [19]

DeFelice et al.

[11] Patent Number: 4,656,682

[45] Date of Patent: Apr. 14, 1987

[54] BED CLOTHING

[76] Inventors: Susan F. DeFelice, 7 Starboard La., Barrington, R.I. 02806; Mary L. Gatta, 259 Lexington Ave., North Providence, R.I. 02904; Roger P. DeFelice, 7 Starboard La., Barrington, R.I. 02806

[21] Appl. No.: 770,612

[22] Filed: Aug. 29, 1985

[51] Int. Cl.[4] ..... A47G 9/02; A47G 9/04

[52] U.S. Cl. ..... 5/494; 5/497; 5/485

[58] Field of Search ..... 5/485, 494–500, 5/502, 413, 417–420

[56] References Cited

U.S. PATENT DOCUMENTS

| | | | |
|---|---|---|---|
| 1,865,329 | 6/1932 | McHorter | 5/500 |
| 2,151,375 | 3/1939 | De Voe | 5/497 |
| 2,525,713 | 10/1950 | North | 5/502 |
| 2,695,414 | 11/1954 | Ford | 5/497 |
| 3,258,789 | 7/1966 | Banks | 5/485 |
| 3,654,646 | 4/1972 | McMahon | 5/497 |
| 3,962,739 | 6/1976 | Crockett | 5/497 |
| 4,045,831 | 9/1977 | Clark | 5/497 |
| 4,197,601 | 4/1980 | Maguire | 5/497 |
| 4,237,380 | 6/1981 | Silvestri | 297/191 |
| 4,437,805 | 12/1980 | Ferrante et al. | 5/497 |

FOREIGN PATENT DOCUMENTS

| | | | |
|---|---|---|---|
| 2072007 | 9/1981 | United Kingdom | 5/500 |

*Primary Examiner*—Gary L. Smith
*Assistant Examiner*—Michael F. Trettel
*Attorney, Agent, or Firm*—Barlow & Barlow, Ltd.

[57] ABSTRACT

An article of bedding having an upper and lower sheet with a two part pouch stitched to the bottom edge of both sheets is disclosed whereby the pouch serves as both an anchor for the sheets on the mattress and a bag therefore.

5 Claims, 5 Drawing Figures

BED CLOTHING

BACKGROUND OF THE INVENTION

This invention relates to improvements in bed clothing which may take the form of blankets, sheets, covers and the like, all of which are placed in position on and over the mattress of a bed. In V-shaped bunks that are found on boats, at the forward end thereof, it is very difficult to make up a bed with a standard rectangular set of sheets. Due to limited access from the sides one has to crawl onto the mattress and attempt to tuck in the foot of the berth and finds that there is considerable overage of material that has to be placed under the narrow end of the mattress. Even in conventional rectangular beds, it is a time consuming project to first place fitted bottom sheet on the mattress and then put a top sheet thereon, particularly when one wants to make up a bed rapidly for an unexpected guest.

In the prior art a number of attempts have been made to provide fitted bed clothing, particularly those that combine a top and bottom bed sheets, as for example, in the Crocket patent U.S. Pat. No. 3,962,739. However, there still exists a need for a one piece bed sheeting arrangement which does not utilize elastic strips to fit the bed sheets to the mattress.

SUMMARY OF THE INVENTION

The present invention provides a construction of bed clothing in which the bed clothing is held and maintained at the foot end of the mattress against displacement by forming a upper and lower sheet joined at one end to which is attached a pouch. The pouch essentially has two side portions which are stitched to the bottom end of the sheets so that one side portion normally lies against the upper sheet and the other side portion lies against the lower sheet. By taking the pouch sidewall that lies against the top sheet and reversing it so that it now lies under the lower sheet with its other side wall, a pocket is effectively formed that is closed on three sides, defined by the lower sheet and one of the side walls of the pouch. When the bed covering is in place on a mattress, the mattress will engage the pouch and the upper and lower sheet can be pulled up tightly against the foot of the mattress. To maintain the continuity of the upper and lower sheet, the side edges are stitched together for a portion of their length extending away from the bottom end of the sheets and by properly sizing the upper sheet to the bottom sheet, a bedding with sufficient room for one's feet are properly provided and sufficient flaps can be formed by the lower sheet so that the same may be tucked in under the mattress. When it is desired to remove the bed clothing, one side wall of the pouch is flipped over the upper sheet and the two sheets are removed from the bed on the top end, folded up and may be stuffed into the pouch so that it may be carried away to washing facilities.

DESCRIPTION OF THE PREFERRED EMBODIMENT

Figure 1:
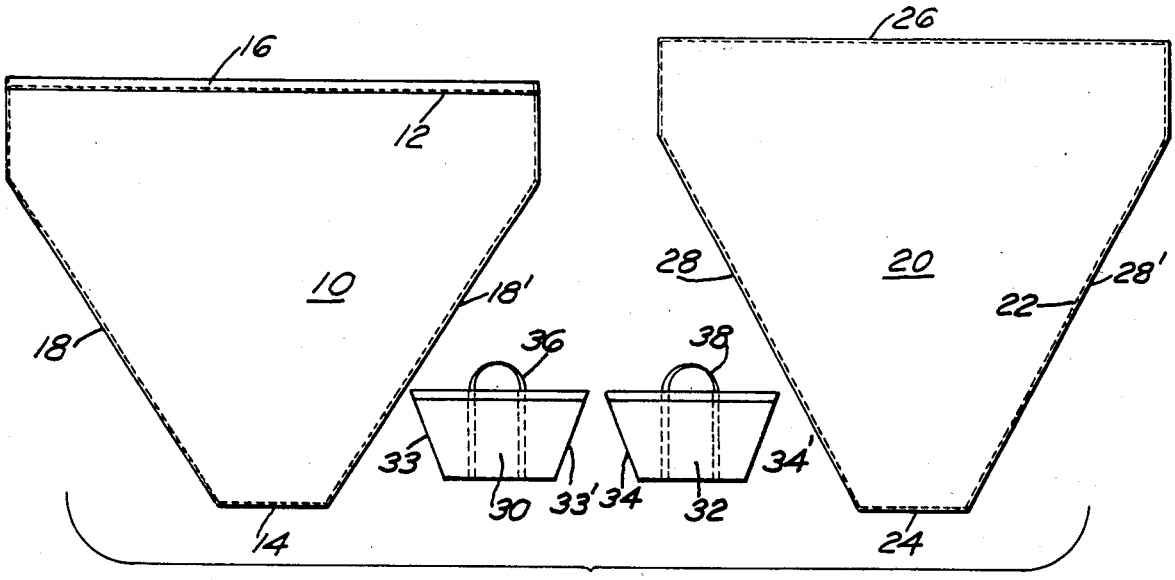
FIG. 1 is a detached planned view showing the various parts of the bed clothing.

Referring now to the drawings and particularly FIG. 1, the bed clothing is illustrated in a form in which the sheets are cut particularly for a V-shaped berth, although it should be understood as this description procededs that the same considerations would apply for a regular rectangular mattress. As illustrated, 10 is the top or upper sheet that is hemmed along all edges thereof as seen by the broken line 12. To fit onto a V-berth, the bottom edge 14 which forms the foot end is narrower than the top edge 16 and, of course, the side edges 18, 18' are tapered to configure the sheet to the particular V-shaped berth found in conventional sailboats and motorboats in the forward section thereof. The lower or bottom sheet 20 is similarly configured there being a hem along all edges thereof as seen by the bottom line 22. The lower sheet also has a narrow bottom edge 24 at the foot end, the top edge 26 being formed in such a way that it extends further away from the bottom edge 24 than does the distance between the top and bottom of the top sheet 10. This is done so that the lower sheet will cover the entire mattress and allow portions thereof for tucking in under the mattress. The bottom sheet 20 also has angled side edges 28, 28'.

Figure 2:
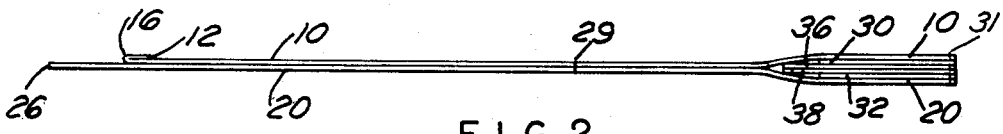
FIG. 2 is a side elevational view illustrating the bed clothing fully formed as it is initially stitched together.

A pouch is formed for the upper and lower sheets out of two pieces of material 30, 32 together with handles 36 and 28, which are illustrated in FIG. 1, and these two pieces of material are laid under the upper and lower sheet, (see FIG. 2). The bottom edges 14 and 24 along with the pouch pieces are now stitched together as at 31. Additionally, the side edges 33, 33', 34, 34' of the portions 30, 32, are stitched to the side edges 18, 18', 28, 28' and stitching is continued up to about one-half of the side edges to maintain an integral structure. When the stiching is complete, the structure is turned inside out.

Figure 3:
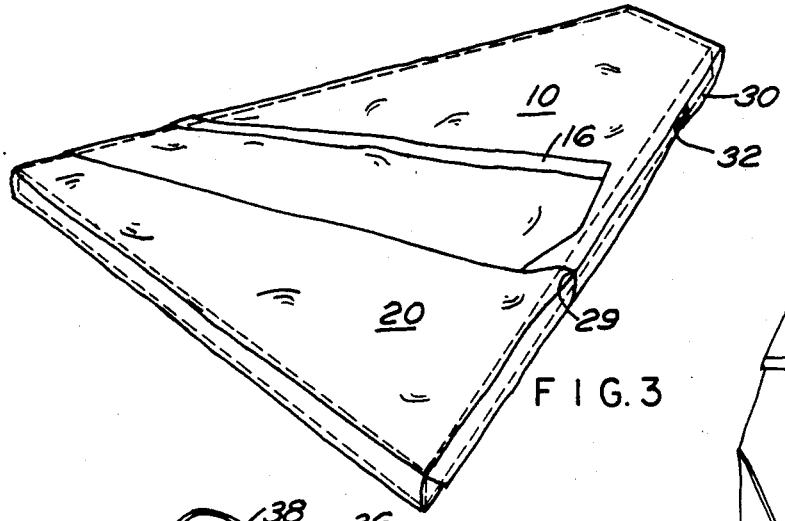
FIG. 3 is perspective view showing the bed clothing affixed to a mattress.

As seen in FIG. 3, the bedding has been placed onto a mattress and in so doing faces of the portions 30, 32 lie juxtaposed to the lower sheet 20.

Figure 4:
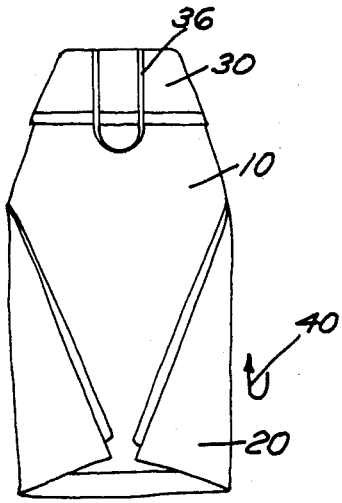
FIG. 4 is an illustration of the manner is which the bed clothing may be folded up and tucket into the pouch.
Figure 5:
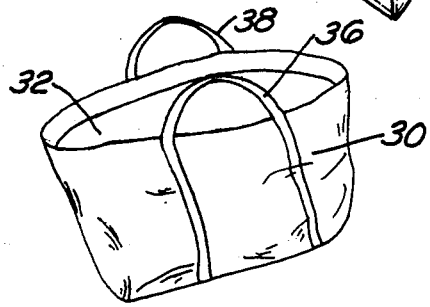
FIG. 5 shows the pouch with the bed clothing therein ready for transport.

When it is desired to take the bedding off the mattress, the portion 30 is then flipped over the end to lie on top of the upper sheet as seen in FIG. 4 and the bedding folded up as seen by the arrow 40 to be tucked within what is now a carrying bag formed by the portions 30 and 32 resulting in an arrangement as seen in FIG. 5.

I claim:

1. An article of bedding for covering a mattress comprising an upper sheet and a lower sheet joined at one end, a pouch consisting of two separate similarly shaped portions having juxtaposed faces with each portion being sewn to the sheets at said one end such that the pouch has an open top and closed bottom and side edges, the bottom and side edges of said pouch secured to the said one end of the lower and upper sheets so that the face of one of the portions normally lies juxtaposed to the lower sheet and the other portion lies on the outside of the upper sheet whereby the one portion of the pouch may receive the end of a mattress and lie thereunder and the other portion lies over the upper sheet the two portions forming a carrying bag for the sheets.

2. An article of bedding as in claim 1 wherein the upper and lower sheet have side edges extending from said one end said upper and lower sheets joined for a portion along their side edges from said one end.

3. An article of bedding as in claim 1 wherein said lower sheet has a length greater than the upper sheet.

4. An article of bedding as in claim 1 wherein the upper and lower sheets are truncated triangular in shape.

5. An article of bedding as in claim 1 wherein the pouch is formed with a handle affixed to at least the open top of one portion.

* * * * *